United States Patent [19]

Kruesi et al.

[11] 4,321,089

[45] Mar. 23, 1982

[54] PROCESS FOR THE RECOVERY OF MOLYBDENUM AND RHENIUM FROM THEIR SULFIDE ORES

[75] Inventors: Paul R. Kruesi, Golden; Veryl H. Frahm, Jr., Boulder, both of Colo.

[73] Assignee: Cato Research Corporation, Wheat Ridge, Colo.

[21] Appl. No.: 158,449

[22] Filed: Jun. 11, 1980

[51] Int. Cl.[3] ..... C22B 1/11; C22B 34/34; C22B 34/00

[52] U.S. Cl. ..... 75/84.5; 75/0.5 BB; 75/84; 75/1 R; 423/49; 423/53

[58] Field of Search ..... 75/0.5 BB, 84.5, 84.4, 75/84, 7, 1 R; 204/157.1 R, 157.1 H; 423/49, 53

[56] References Cited

U.S. PATENT DOCUMENTS

| | | | |
|---|---|---|---|
| 3,261,959 | 7/1966 | Connell et al. | 75/1 R |
| 3,955,960 | 5/1976 | Gorling | 75/3 |
| 4,076,607 | 2/1978 | Zavitsanos et al. | 44/15 R |
| 4,123,230 | 10/1978 | Kirkbride | 44/15 R |
| 4,144,056 | 3/1979 | Kruesi | 423/49 |
| 4,148,614 | 4/1979 | Kirkbride | 44/15 R |
| 4,152,120 | 5/1979 | Zavitsanos et al. | 44/15 R |

OTHER PUBLICATIONS

Zavitsanos, P. D., et al., *Coal Desulfurization Using Microwave Energy,* Report No. EPA-600/7-78-089, U.S. EPA, pp. 1-68 (1978).

*Primary Examiner*—O. R. Vertiz
*Assistant Examiner*—Mark Bell
*Attorney, Agent, or Firm*—Sheridan, Ross & McIntosh

[57] ABSTRACT

A process for the recovery of molybdenum and rhenium from their sulfide ores which comprises subjecting the ores to microwave energy in the presence of oxygen to selectively heat the sulfides to convert them to oxides, and recovering the formed oxides. Alternatively, the sulfides in the ore are selectively heated with microwave energy in the presence of chlorine to convert them to the corresponding chlorides, and the metals recovered from the chlorides.

20 Claims, No Drawings

PROCESS FOR THE RECOVERY OF MOLYBDENUM AND RHENIUM FROM THEIR SULFIDE ORESDESCRIPTION

TECHNICAL FIELD

The process of the present invention relates to the use of microwave energy in the recovery of molybdenum and rhenium compounds from molybdenum and rhenium sulfides.

BACKGROUND ART

The principal ores of molybdenum are those containing molybdenum disulfide or molybdenite. These ores commonly contain only a few tenths to one half of one percent of the molybdenite. Rhenium sulfide is associated with molybdenum in the ores. In order to recover the valuable molybdenum it is necessary to mine large amounts of the host rock, crush and grind the rock to very small particles, float the molybdenum to separate it from the host rock gangue and to separate if from contaminating minerals, and finally to roast the molybdenite to molybdenum oxide or otherwise convert it to useful chemical compounds.

The various processes involved use prodigious amounts of energy, and because of the low grades of materials being treated, result in high losses of the valuable molybdenum and rhenium.

Molybdenite once recovered is converted to molybdenum oxide by roasting it in the presence of oxygen which may be supplied by air. In the course of the roasting a great deal of heat is generated because of the exothermic reactions producing molybdenum trioxide and sulfur dioxide. Additional or excess air over that required for oxidation is frequently used during the roasting to cool the burning mass to prevent it from becoming so hot that it fuses, or that the molybdenum oxide volatilizes. As a result, the sulfur dioxide coming from the molybdenum roaster is frequently quite dilute and converted into sulfuric acid only with excessive expense.

During the roasting of molybdenite, rhenium is oxidized and at the temperature of roasting becomes volatile. Given the large volumes of gases emitted by burning organic feeds to initiate the roasting, the large volumes of sulfur dioxide from the roasting and the large volumes of air needed to cool the reaction, the recovery of the valuable rhenium is difficult and expensive.

In roasting of molybdenite, the molybdenum oxide being formed tends to coat the as yet unreacted molybenite and form an insulating layer which inhibits further reaction. As the heat and oxygen necessary to reaction must pass through this layer, it is difficult to obtain a complete roasting of the molybdenite.

In the flotation of molybdenite it is necessary to grind the ore sufficiently so as to liberate the grains of molybdenite. In doing this, often a portion of the molybdenite, which is very soft, is overground and becomes so fine (minus 10 microns) that it no longer responds well to flotation and tends to become lost in the tailings from the flotation cleaning circuits. This molybdenite could be recovered by cyclones, but its grade would be too low for practical conversion to molybdenum oxide. That is, the energy required to heat up the total gangue to roasting temperature would be too expensive to justify the added molybdenum recovery.

The grinding of molybdenite ore in order to achieve liberation of the molybdenite particles requires prodigious amounts of energy. A means of recovering the molybdenum and rehnium values without the necessity of such grinding would be a great energy and cost saver.

Microwaves are well known for their use in radar and communication transmission. They have been extensively used as a source of energy for cooking foods. Although they have been studied for many years and put to practical uses, the effects which they have on many materials is not known. The effects of microwaves upon ores and minerals is not known, nor can it be readily predicted. The effect of microwaves upon metal values contained within ores and minerals does not appear to be related in any simple way to the chemical and physical properties of such metal values. Thus, while molybdenite and rhenium sulfide strongly absorb microwaves and become heated, molybdenum oxide is largely transparent to microwaves. Copper sulfides strongly absorb, while zinc sulfide is transparent.

In treating molybdenite ores it has been found possible in accordance with this invention to selectively heat the strongly absorbing molybdenite without heating the surrounding transparent gangue silicates.

U.S. Pat. No. 2,733,983 to Daubenspeck teaches the use of ferric chloride at high temperatures of 600° C. to 700° C. to chlorinate nickel and cobalt oxides. U.S. Pat. No. 4,144,056 to Kruesi discloses heating a metal oxide or silicate in the absence of air with ferric chloride and a volatility depressant salt selected from the group consisting of alkali metal chlorides and ammonium chlorides for a time of about 30 minutes to about 1 hour at temperatures of from about 200° C. to about 600° C. Conventional heat sources are used in both processes where heat is required.

U.S. Pat. Nos. 4,123,230 and 4,148,614, both to Kirkbride, disclose the desulfurization of coal by subjecting the coal or slurry of coal particles in a hydrogen atmosphere to microwave energy to form hydrogen sulfide which is removed from the coal with solvents. U.S. Pat. No. 4,152,120 to Zavitsanos, et al, removes pyrite and organic sulfur from coal by mixing alkali metals or alkaline earth compounds with the coal and using microwave energy to selectively heat these compounds and the sulfur to convert organic and pyritic sulfur to soluble alkali and alkaline earth compounds which are removed from the coal. The subject matter of this patent is also disclosed in an article entitled "Coal Desulfurization Using Microwave Energy," Zavitsanus et al, published in U.S. Department of Commerce PB285-880, June, 1978. This patent and the article teach the use of microwave energy to selectively heat pyritic and organic sulfur contained in the organic host material coal in the presence of other elements or compounds to convert the sulfur into soluble compounds which can be readily removed from the coal. They do not teach the use of microwave energy to selectively heat metal compounds in their inorganic mineral-like host materials, alone or in the presence of other elements or compounds, to form soluble compounds of the metals which are readily recoverable from the host materials. Particularly, they do not teach the unpredictable finding that the process will work on certain ores or minerals containing metal values and not on other ores and minerals to recover their metal values.

DISCLOSURE OF INVENTION

Microwave energy is used in processes requiring heat to recover molybdenum and rhenium from their sulfides by selectively heating the sulfides in the presence of oxygen. The microwave energy is used in conventional processes for the recovery of these metals from their sulfides in place of conventional heat sources.

Where molybdenite and rhenium sulfide occur with a silicate gangue, the microwaves selectively heat the molybdenite and rhenium sulfide to a temperature where roasting with air or oxygen produces molybdenum and rhenium oxides and sulfur dioxide. Because the microwaves are selective for the sulfides, it is not necessary to heat the entire mineral mass to roasting temperature.

The formed molybdenum and rhenium oxides are then conveniently recovered by leaching with ammonia or with caustic soda, and then treated by well known processes to precipitate molybdenum and rhenium compounds. Alternatively, the molybdenite and rhenium sulfide can be chlorinated to molybdenum and rhenium chlorides which are volatile by selectively heating them in their ores in the presence of chlorine. Again, because only the molybdenite and rhenium are heated by the microwaves, the whole gangue mass does not have to be heated. The chlorination reaction requires a temperature at least of about 600° C. This is readily achieved with the microwaves.

In roasting of a molybdenite concentrate the molybdenite can be brought to roasting temperature by the use of microwaves. This obviates the need for combustion of fuel to supply heat and thereby permits a more closely controlled roast and one in which the total gases produced are less. Because the microwaves pass through the transparent molybdenum oxide as it is formed and heat the molybdenum sulfide, the fact that there are oxide coatings does not inhibit the reaction and a more complete roasting can be accomplished in a shorter time. The thermal difference between the heated molybdenum sulfide and the unheated molybdenum oxide is sufficient to destroy the continuity of the oxide coating.

Inasmuch as the molybdenite and rhenium sulfide are heated internally by the microwaves, it is not necessary to grind ore so fine that the particles are liberated. It is sufficient that a surface be exposed so that the roasting conversion to molybdenum and rhenium oxides of the chlorination reaction to molybdenum and rhenium chlorides can occur. The removal of the necessity for fine grinding can greatly decrease the overall energy required for the recovery of molybdenum and rhenium.

BEST MODE FOR CARRYING OUT THE INVENTION

The process of the present invention is applicable to the selective heating of the sulfides of molybdenum and rhenium in their ores in the presence of oxygen or chlorine to convert the sulfides to oxides or chlorides.

It is preferred that the molybdenum and rhenium ores be ground to a size of 12 mesh or smaller so that the individual particles of molybdenite and rhenium sulfide have at least one surface exposed to the gases to be used for reaction.

In the roasting of molybdenite and rhenium sulfide ores to their oxides it is preferred to use the microwaves to selectively heat the sulfides to at least 300° C. in order to get a complete reaction with oxygen, either diluted with other gases as in air, or pure.

It is preferred that the sulfides of molybdenum and rhenium be dried prior to reaction with microwaves.

Microwave heating can be used to selectively heat the molybdenite and rhenium sulfide to reaction temperature in the presence of chlorine to produce molybdenum and rhenium chloride and elemental sulfur. The operative temperature for this reaction is at least 300° C. and 600° C. is preferred. After chlorination, the molybdenum and rhenium chlorides can be processed by known means such as hydrogen reduction to produce the metals, or by reaction with water and ammonia or caustic to produce the oxides. The reaction time for either roasting or chlorination will depend upon the grade of the material being treated. Very low grade feeds will have a certain amount of heat loss to the surrounding gangue by conduction away from the heating molybdenum and rhenium sulfides. There will be a proportionately small heat loss from the exothermic oxidation and chlorination reactions. The sulfides in very low grade materials will generally be converted in 15 minutes, and in high grade material in 3 to 5 minutes. Because of the high speed of reaction in the microwave field, equipment size is minimal and great capital savings result.

In the roasting of molybdenite, zones of microwave energy can be advantageously used to provide additional heat to the molybdenite, which is almost completely roasted, carrying the reaction to completion. It is possible to combine the useful effects of microwave heating with conventional processes.

The invention is further illustrated by the following examples.

EXAMPLE 1

The following materials were all irradiated with microwave radiation of the indicated wavelength and at power levels of 600 watts for the 2450 megahertz radiation. Water was used as a ballast to prevent overheating of the microwave generator where the absorption of radiation was slight. The radiation was continued for 6 minutes and then the temperature of the substance was measured as quickly as possible to determine the relative absorbence of the microwave energy.

| Substance | 300 watts 2450 megahertz Temp °C. |
|---|---|
| Sand | 36 |
| Iron Oxide | 34 |
| Zinc Sulfide | 34 |
| Molybdenite | 212 |
| Rhenium Sulfide | 162 |
| Molybdenum Oxide | 33 |

It is seen from the above results that molybdenum and rhenium sulfides strongly absorb microwaves, while sand, iron and molybdenum oxides and zinc sulfide do not appreciably absorb microwaves.

EXAMPLE 2

The following materials were all irradiated with microwaves of 915 megahertz and at a power level of about 280 watts for 6 minutes. Water was used as a ballast to prevent the overheating of the generator.

| Material | Temperature Increase °C. |
|---|---|
| Sand | 11 |
| Iron Oxide | 10 |
| Zinc Sulfide | 14 |
| Molybdenite | 25 |
| Rhenium Sulfide | 28 |
| Molybdenum Oxide | 11 |

As may be noted, molybdenum and rhenium sulfides are better absorbers of the radiation than the other materials tested.

EXAMPLE 3

A molybdenite mine rock waste which was too low grade for recovery of molybdenum by conventional practice, assaying 0.054 percent molybdenum, was ground to minus 14 mesh. The minus 48 mesh fraction was 24.1 percent of the weight, assayed 0.092 percent molybdenum, and represented 40 percent of the molybdenum in the head sample. Fifty grams of this minus 48 mesh material was blended with 0.5 grams of iron as ferrous chloride and one gram of potassium chloride. The sample was dried. It was irradiated for six and one-half minutes with 600 watts of 2450 megahertz radiation in a chlorine atmosphere. Fifty-five percent of the molybdenum was found to be soluble in dilute acid, leaving a tailing assaying only 0.041 molybdenum.

EXAMPLE 4

A flotation reject which assayed 6 percent molybdenum was subjected to a flow of oxygen and 2450 megahertz radiation for 15 minutes. The mass was allowed to cool and was leached with caustic at pH 13. Sixty-five percent of the molybdenum was found to have been roasted and to be soluble.

EXAMPLE 5

One-hundred grams of a commercial molybdenite concentrate assaying 53 percent molybdenum was deoiled by irradiating with 600 watts of 2450 megahertz radiation for 5 minutes. It was then subjected to a flow of oxygen and irradiated for 14 minutes to initiate the roasting reaction. Subsequently, the irradiation was periodically imposed in short pulses to return the unreacted molybdenite to reaction temperature as it cooled. The irradiation was on for 32 minutes over a two and one-half hour period. At the end of the roast 91 percent of the molybdenum was soluble in caustic.

EXAMPLE 6

Five grams of a commercial molybdenite concentrate containing 53 percent molybdenum was irradiated at 300 watts and 2450 megahertz for 35 minutes in a flow of chlorine. The molybdenite was chlorinated. At the end of the reaction the small residue was leached with caustic to remove soluble molybdenum which had not been volatilized. The yield of volatile and soluble molybdenum was 92 percent.

EXAMPLE 7

Five grams of a molybdenite concentrate rich in rhenium was irradiated in a flow of chlorine with 300 watts of 2450 megahertz radiation for 45 minutes. A caustic solution was used to scrub the gases leaving the reactor, and the residue was leached with caustic to pH 13. Molybdenum recovered in soluble form was 61 percent of the total molybdenum. Rhenium extraction was 99 percent of the total rhenium.

From the above examples it is seen that the process of the invention is effective for the recovery of molybdenum and rhenium from their sulfide ores, including ores too poor for the recovery of the metals by conventional processes. It is noted that all the host materials in the examples are inorganic materials. The invention is particularly applicable to the recovery of metal values from inorganic host materials, such as, gangues associated with metals, silicates, etc. The ore material should be heated for a sufficient time to convert a substantial amount of the metal compound in the ore to the required compound in the interest of efficiency. Microwave frequencies used will fepend on various factors involved. Different frequencies may be used at the same time or on the same batch of ore.

We claim:

1. A process for the recovery of a metal selected from the group consisting of molybdenum and rhenium from their sulfide ores which comprises subjecting the ores to microwave energy in the presence of oxygen or chlorine to selectively heat the sulfides to convert the sulfides to oxides or chlorides, respectively, and recovering the metals from the formed oxides or chlorides.

2. The process of claim 1 wherein the sulfides are heated to at least about 300° C.

3. The process of claim 1 wherein the sulfide is molybdenum sulfide and the metal recovered is molybdenum.

4. The process of claim 3 wherein molybdenum sulfide is heated in the presence of oxygen, the oxide of molybdenum is formed, and molybdenum is recovered from the formed oxide.

5. The process of claim 4 in which the molybdenum sulfide is heated to a temperature of at least about 300° C.

6. The process of claim 3 wherein the molybdenum sulfide is heated in the presence of chlorine, the chloride of molybdenum is formed, and molybdenum is recovered from the formed chloride.

7. The process of claim 6 wherein the molybdenum sulfide is heated to about 600° C.

8. The process of claim 1 wherein the sulfide is rhenium sulfide and the metal recovered is rhenium.

9. The process of claim 8 wherein the rhenium sulfide is heated in the presence of oxygen, the oxide of rhenium is formed, and rhenium is recovered from the formed oxide.

10. The process of claim 9 wherein the rhenium sulfide is heated to at least about 300° C.

11. The process of claim 8 wherein the rhenium sulfide is heated in the presence of chlorine, the chloride of rhenium is formed, and rhenium is recovered from the formed chloride.

12. The process of claim 11 wherein the rhenium sulfide is heated to about 600° C.

13. The process of claim 6 wherein the chlorine source is one selected from the group consisting of chlorine gas, ferrous chloride, ferric chloride, cuprous chloride, cupric chloride, and mixtures thereof.

14. The process of claim 13 wherein the source of chlorine is ferric chloride.

15. The process of claim 13 wherein ferrous chloride is added to the molybdenum sulfide and the chlorination reaction is initiated by the addition of chlorine gas to promote the formation of ferric chloride.

16. The process of claim 8 wherein the chloride source is one selected from the group consisting of chlorine gas, ferrous chloride, ferric chloride, cuprous chloride, cupric chloride and mixtures thereof.

17. The process of claim 16 wherein the source of chlorine is ferric chloride.

18. The process of claim 16 wherein ferrous chloride is added to the molybdenum sulfide and the chlorination reaction is initiated by the addition of chlorine gas to cause the formation of ferric chloride.

19. The process of claim 1 in which the ore is molybdenite.

20. The process of claim 19 wherein the host material for the molybdenite is a silicate gangue.

* * * * *